US009429030B2

(12) United States Patent
Bart et al.

(10) Patent No.: US 9,429,030 B2
(45) Date of Patent: Aug. 30, 2016

(54) DEVICE FOR LOCKING A ROOT OF A ROTOR BLADE

(75) Inventors: Jacques Rene Bart, Soisy sur Seine (FR); Antoine Jean-Philippe Beaujard, Vaux-le-Penil (FR)

(73) Assignee: SNECMA, Paris (FR)

( * ) Notice: Subject to any disclaimer, the term of this patent is extended or adjusted under 35 U.S.C. 154(b) by 848 days.

(21) Appl. No.: 13/816,083

(22) PCT Filed: Aug. 8, 2011

(86) PCT No.: PCT/FR2011/051882

§ 371 (c)(1),
(2), (4) Date: Feb. 8, 2013

(87) PCT Pub. No.: WO2012/020195

PCT Pub. Date: Feb. 16, 2012

(65) Prior Publication Data

US 2013/0136605 A1 May 30, 2013

(30) Foreign Application Priority Data

Aug. 10, 2010 (FR) ..... 10 56528

(51) Int. Cl.
*F01D 5/32* (2006.01)
*F01D 5/30* (2006.01)

(52) U.S. Cl.
CPC ..... *F01D 5/326* (2013.01); *F01D 5/3084* (2013.01); *F01D 5/323* (2013.01)

(58) Field of Classification Search
CPC ..... F01D 11/006; F01D 11/008; F01D 5/30; F01D 5/3007; F01D 5/3015; F01D 5/3069; F01D 5/3084; F01D 5/3053; F01D 5/3092; F01D 5/32; F01D 5/323; F01D 5/326
See application file for complete search history.

(56) References Cited

U.S. PATENT DOCUMENTS 1,873,956 A * 8/1932 Dahlstrand ..... F01D 5/025 403/358
3,076,634 A * 2/1963 Boyle ..... F01D 5/323 416/221

(Continued)

FOREIGN PATENT DOCUMENTS

CA 604830 9/1960
CN 1524160 A 8/2004

(Continued)

OTHER PUBLICATIONS

International Search Report Issued Nov. 11, 2011 in PCT/FR11/051882 Filed Aug. 8, 2011.

*Primary Examiner* — Dwayne J White
*Assistant Examiner* — Joshua R Beebe
(74) *Attorney, Agent, or Firm* — Oblon, McClelland, Maier & Neustadt, L.L.P.

(57) ABSTRACT

A device for locking a root of a rotor blade in a groove in a rotor disk of a turbomachine including: a circular ring sector configured to be mounted, transversely to the axis of the turbomachine, in a groove in the rotor disk; at least one locking wedge, which is rigidly secured and perpendicular to the ring sector, and extends parallel to the axis of the ring sector so as to hold the root of the blade radially in the groove; and at least one locking tooth extending from the ring sector radially with respect to the axis of the ring sector, so as to prevent the root of the blade from moving axially in the groove.

12 Claims, 3 Drawing Sheets

(56) References Cited

U.S. PATENT DOCUMENTS

| | | | | | |
|---|---|---|---|---|---|
| 3,343,806 | A * | 9/1967 | Bobo | F01D 5/06 | 415/115 |
| 3,807,898 | A * | 4/1974 | Guy | F01D 5/3015 | 416/221 |
| 3,945,758 | A * | 3/1976 | Lee | F01D 5/187 | 415/115 |
| 4,207,029 | A | 6/1980 | Ivanko | | |
| 4,470,757 | A * | 9/1984 | Vollinger | F01D 5/3015 | 416/193 A |
| 4,507,052 | A * | 3/1985 | Thompson | F01D 11/006 | 415/173.7 |
| 4,659,285 | A * | 4/1987 | Kalogeros | F01D 5/3015 | 416/220 R |
| 4,668,167 | A * | 5/1987 | Le Mao/u/ t | F01D 5/3015 | 416/193 A |
| 4,781,534 | A * | 11/1988 | Ferleger | F01D 11/006 | 416/193 A |
| 5,222,865 | A | 6/1993 | Corsmeier | | |
| 5,320,492 | A * | 6/1994 | Bouru | F01D 5/3015 | 416/220 R |
| 7,329,101 | B2 * | 2/2008 | Carper | C04B 35/565 | 416/219 R |
| 7,458,769 | B2 | 12/2008 | Forgue et al. | | |
| 8,157,506 | B2 | 4/2012 | Bart et al. | | |
| 2005/0249590 | A1 | 11/2005 | Marchi | | |
| 2008/0253895 | A1 * | 10/2008 | Gekht | F01D 5/323 | 416/220 R |
| 2009/0304495 | A1 * | 12/2009 | Bart | F01D 5/082 | 415/116 |
| 2011/0250071 | A1 * | 10/2011 | Arilla | F01D 5/3007 | 416/220 R |

FOREIGN PATENT DOCUMENTS

| | | |
|---|---|---|
| CN | 1900533 A | 1/2007 |
| FR | 2 524 933 | 10/1983 |
| FR | 2 939 834 | 6/2010 |
| WO | 03/004834 | 1/2003 |

* cited by examiner

DEVICE FOR LOCKING A ROOT OF A ROTOR BLADE

BACKGROUND OF THE INVENTION

1. Field of the Invention

The invention relates to the field of turboengine rotors and more specifically to the retention of rotor blades on a rotor disk.

2. Description of the Related Art

A turboreactor having a front fan and turn spool, for example, conventionally comprises, in sequence in a downstream direction, a fan, a low-pressure compressor stage, a high-pressure compressor stage, a combustion chamber, a high-pressure turbine stage and a low-pressure turbine stage.

In the present application, the terms "upstream" and "downstream" are, by convention, defined relative to the direction of circulation of air in the turboreactor. In the same manner, in the present application, the terms "inner" and "outer" are, by convention, defined radially relative to the axis of the engine. Thus, a cylinder which extends along the axis of the engine comprises an inner face which is directed toward the axis of the engine and an outer surface opposite the inner surface thereof.

In conventional manner, with reference to FIG. 1, a low-pressure turbine stage comprises, for example, successive rotor disks 1 which each comprise axial or oblique grooves 11 in which blades 2 are engaged by means of the roots 3 thereof, the blades 2 extending radially outward relative to the axis X of the engine.

The blades 2 are radially retained in the grooves by means of the fir-tree-like roots 3 thereof which further allows a space to be created between the root 3 and the base of the groove in order to allow a circulation of air which is guided in the body of the blades in order to ventilate them. The blades 2 are retained in an axially upstream direction by means of a sealing ring 4 which comprises sealing plates, the sealing ring 4 being known to the person skilled in the art as a "labyrinth ring".

In order to retain the blades 2 in an axially downstream position, a circumferential ring sector 5 is mounted between a recess 6 of the rotor disk 1 and a downstream hook 7 of the root 3 of the blade 2. In this manner, in the position for use, the ring sector 5 blocks the axial movement of the blade 2 in a downstream direction, the blade 2 remaining fixedly joined to the rotor disk 1.

Currently, the roots 3 of the blades 2 are of metal material. In order to reduce the mass of the engine, it is proposed that the roots 3 be formed of composite material. The current method for fixing a metal root cannot be transferred to the fixing of a root made of composite material. This is because a conventional composite material does not allow concave zones to be formed simply in the blade root. Thus, it is difficult to form a downstream hook in the blade root in order to ensure the downstream axial retention of the blade by a ring sector. Furthermore, the production of a fir-tree-like blade root from composite material is not preferred. This is because during the operation of the engine, differential expansions appear and the teeth of the fir-tree-like root are no longer in abutment in the groove of the rotor disk. The radial retention of the blade is not satisfactory.

BRIEF SUMMARY OF THE INVENTION

In order to eliminate at least some of these disadvantages, the invention relates to a device for securing a root of a rotor blade in a groove of a rotor disk of a turboengine, comprising:

- a circular ring sector which is intended to be mounted, transversely relative to the axis of the turboengine, in a recess of the rotor disk;
- at least one blocking wedge, which is fixedly joined and orthogonal relative to the ring sector and which extends parallel to the axis of the ring sector in order to radially support the root of the blade in the groove; and
- at least one blocking tooth which extends from the ring sector radially relative to the axis of the ring sector in order to block the axial movement of the blade root in the groove.

Owing to the device, it is advantageously possible to secure the dovetail root of a rotor blade which does not comprise an axial blocking hook, in particular, a blade of composite material. Furthermore, this simple assembly device allows a blade to be secured radially and axially with a rotor disk according to the prior art.

Such a one-piece device ensures correct positioning of each tooth and each wedge which is intended to secure the blade root. Furthermore, the device can be rapidly fitted into the rotor since each device may comprise a plurality of teeth and a plurality of blocking wedges.

Preferably, the device comprises ventilation means which are formed in the ring sector and which are arranged to allow discharge of a flow of air which circulates between the base of the groove and the blocking wedge. The blocking wedge allows a ventilation space to be formed between the blade root and the base of the groove in which space a flow of air which is discharged by the ventilation means flows.

More preferably, the ventilation means are aligned with the direction in which the blocking tooth extends. In this manner, the flow of ventilation air cools the blocking wedge, the blade root and the base of the groove which are aligned axially with the blocking tooth.

According to one embodiment of the invention, the ventilation means are in the form of at least one ventilation hole. A hole is simple to machine in the ring sector and allows the discharge of the flow of ventilation air.

According to another embodiment of the invention, the ventilation means are in the form of at least one ventilation notch which is formed in the portion of the ring sector which is intended to be inserted in the recess of the rotor disk.

A ventilation notch allows the mass of the device to be reduced, whilst allowing the flow of air to be discharged. Preferably, the ring sector comprises a notched inner edge.

According to one aspect of the invention, the ring sector comprises an inner radial portion which is intended to be mounted in the recess of the rotor disk, and an outer radial portion from which the blocking tooth extends, which portions are axially offset relative to each other along the axis of the ring.

Advantageously, this offset allows the securing device to be positioned in a precise manner without creating any significant overhang of the blocking wedge relative to its fixing in the recess. Tilting of the securing device is therefore limited.

The invention also relates to a rotor of a turboengine which comprises a rotor disk, at least one rotor blade and at least one securing device as set out above, the rotor disk comprising a groove in which a blade root is accommodated and a recess in which the securing device is mounted, the blocking wedge of the securing device extending between the root of the blade and the base of the groove.

Preferably, since the rotor disk extends axially in a downstream direction, the recess is formed at the downstream end of the rotor disk in order to block an axial downstream movement of the blade in the groove.

According to one aspect of the invention, the root of the rotor blade comprises a casing of composite material.

The blade root of composite material, preferably with a ceramic matrix, is simple to produce and allows a rotor to be formed which includes all the advantages of a rotor according to the prior art with metal blades.

According to another aspect of the invention, the root of the rotor blade is of dovetail form. Owing to the securing device according to the invention, the blade may be radially blocked which prevents any error in the positioning of the blade in its housing when the rotor is in the stopped state.

BRIEF DESCRIPTION OF THE SEVERAL VIEWS OF THE DRAWINGS

The invention will be better understood with reference to the appended drawings, in which.

DETAILED DESCRIPTION OF THE INVENTION

Figure 3:
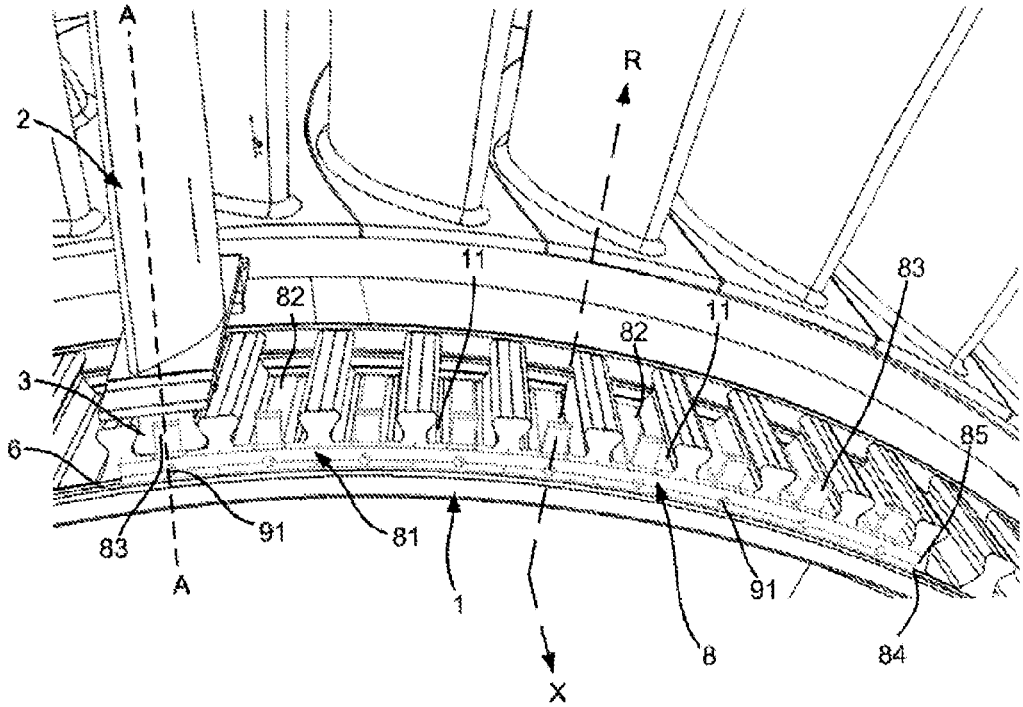
FIG. 3 is a perspective view of a rotor according to the invention comprising a securing device in accordance with FIG. 2, the securing device axially securing a single rotor blade which is mounted in the rotor disk.

The invention will now be set out for a rotor of a turboengine which forms a low-pressure turbine stage. The rotor comprises a low-pressure turbine rotor disk 1 which extends axially along an axis X as illustrated in FIG. 3, in which there are formed axial or oblique grooves 11 in which blades 2 are engaged via the roots 3 thereof, the blades 2 extending radially outward relative to the axis X of the engine. The rotor disk 1 comprises an annular recess 6 which extends radially inward and which is formed downstream of the groove 11 of the rotor disk 1. The invention is described in this instance for downstream blocking but it is self-evident that it can be used in a similar manner for axial upstream blocking.

The rotor further comprises a device 8 for securing a root 3 of a rotor blade 2 in a groove 11 of the rotor disk 1 which device will now be set out with reference to FIGS. 2 to 6. The securing device 8 preferably comprises the same number of blocking wedges 82 as teeth 83. Preferably, each blade 2 of the rotor disk 1 is blocked by a wedge 82 and a blocking tooth 83.

The number of wedges 82 is equal to the numbers of blades 2 to be blocked. In this example, the rotor disk 1 comprises 98 grooves 11 in order to receive the same number of blades 2. In this example, in order to secure the blades 2 in the grooves 11, there are 11 securing devices 8 provided, of which 10 comprise nine wedges 82 and of which one comprises eight wedges 82, each device 8 comprising the same number of wedges 82 as blocking teeth 83.

It is self-evident that the number of wedges 82 per device 8 may vary in accordance with the number of blades of the rotor disk 1 or the number of devices 8 used to block the blades 2 of a rotor disk 1.

Figure 1:
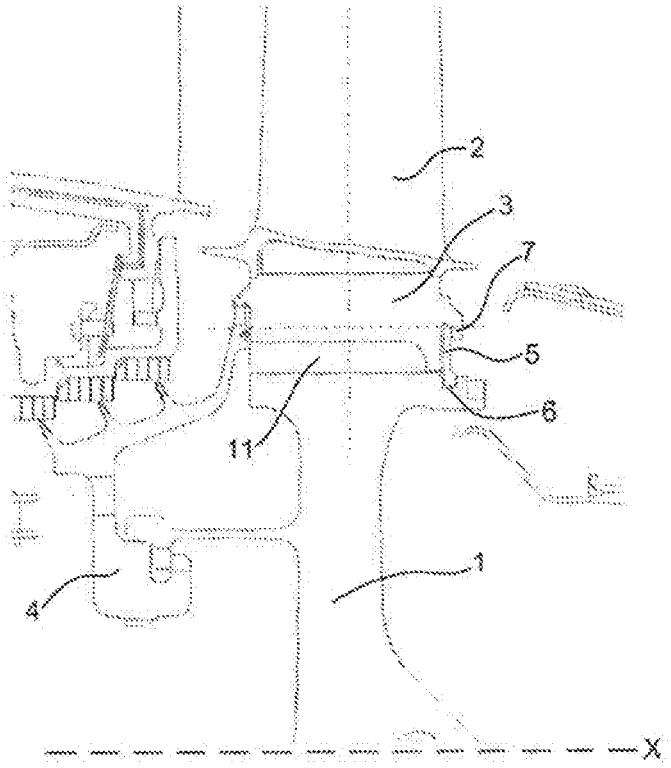
Background Art FIGURE 1
FIG. 1 is a radial section of a rotor disk of a turboengine in which rotor disk a rotor blade according to the prior art is mounted.
Figure 2:
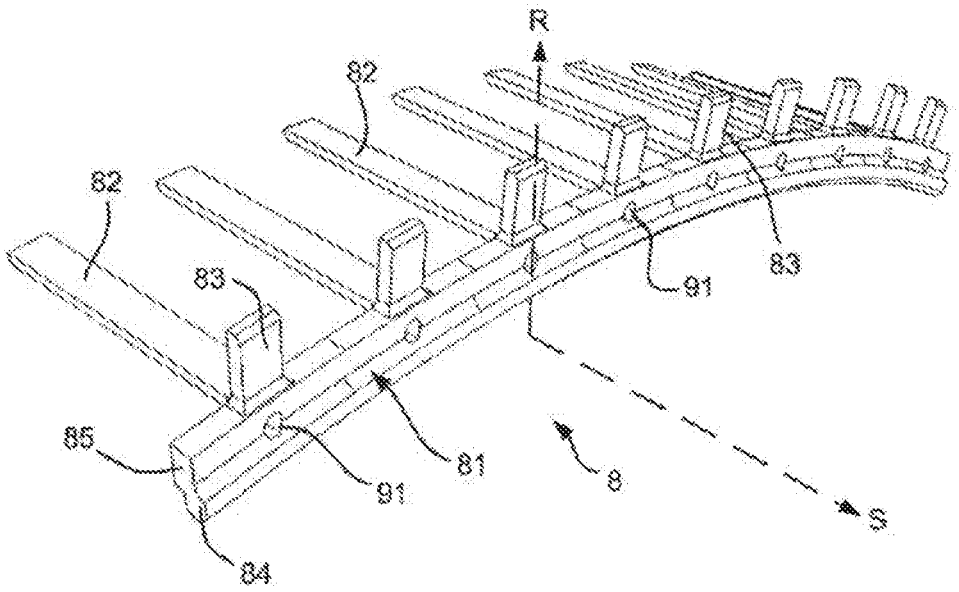
FIG. 2 is a perspective view of a first embodiment of a securing device according to the invention.

With reference to FIG. 2, the securing device 8 generally comprises a circular ring sector 81, at least one blocking wedge 82 and at least one blocking tooth 83 in order to axially secure the root 3 of a rotor blade 3 which is arranged in a groove 11 of the rotor disk 1 whilst allowing the ventilation of the groove 11.

More precisely, the circular ring sector 81 is intended to be mounted transversely relative to the axis of the turboengine, in a recess 6 of the rotor disk 1. By definition, a circular ring sector is defined relative to an axis which is referred to below as the ring axis S which is orientated in a forward direction in FIG. 2 and which defines the axial direction. Below, the terms "front" and "rear" are defined relative to the ring axis S.

The ring sector 81 extends radially relative to the ring axis S in the radial direction of axis R, illustrated in FIG. 2, which is directed from the inner side to the outer side. The circular ring sector 81 has a constant radius of curvature and is flattened in the axial direction S, the radial dimension thereof being longer than the axial dimension thereof.

The ring sector 81 has an open angle in the order of 30□, but this angle may of course be different.

The inner radial portion 84 of the ring sector 81 is axially offset relative to the outer radial portion 85 thereof, as illustrated in FIG. 2. In other words, the inner radial portion 84 is ahead of the outer radial portion 85 in order to allow the inner radial end 84 to be accommodated in the recess 6 of the rotor disk 1 whilst allowing the outer radial portion 85 to move radially into abutment in the groove 11 of the rotor disk 1 as illustrated in FIG. 3. This feature will be set out below with reference to the embodiment of the invention.

The rectangular blocking wedge 82 of the securing device 8 is fixedly joined and orthogonal relative to the ring sector 81, the wedge 82 extending from the rear face of the ring sector 81, parallel to the ring axis S. The blocking wedge 82 is arranged so as to radially support the root 3 of the blade 2 in the groove 11 of the rotor disk 1. With reference to FIG. 2, the blocking wedge 82 is fixedly joined to the upper portion 85 of the ring sector 81 in order to raise the root 3 of the blade 2 relative to the base of the groove 11 in order to allow a circulation of air in the groove 11 of the rotor disk 1.

Figure 4:
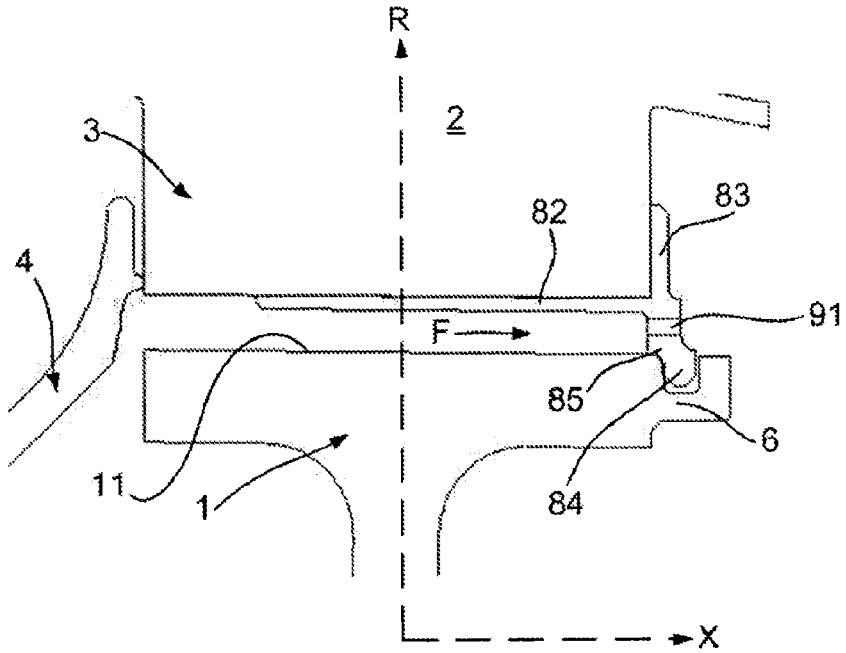
FIG. 4 is a radial section of the rotor of FIG. 3 along the axis A-A.

The blocking wedge 82 of the securing device 8 is flattened in the radial direction R, the axial dimension thereof being longer than the radial dimension thereof. The length of the blocking wedge 82 defined along the ring axis S is configured in order to support the root 3 of the blade 2. By way of example, the length of the blocking wedge 82 corresponds to approximately 80% of the length of the root 3 of the blade 2 as illustrated in FIG. 4. It is self-evident that the length of the blocking wedge 82 may vary. Preferably, the length of the blocking wedge 82 is at least equal to half of the length of the blade root 3 in order to distribute the forces over the blocking wedge 82.

The blocking tooth 83 of the securing device 8 is fixedly joined and orthogonal relative to the blocking wedge 82. The blocking tooth 83, which is rectangular, extends from the upper portion 85 of the ring sector 81 in the radial direction R toward the outer side, that is to say, radially relative to the axis of the ring sector S, in order to block the axial movement of the blade root 3 in the groove 11 of the rotor disk 1. The length of the tooth 83, defined along the radial axis R, is configured in this example so as to extend as far as the outer diameter of the rotor disk 1 when the securing device 8 is in the fitted position as illustrated in FIG. 3.

The dimensions of the blocking tooth 83, in particular the length and the width thereof, are defined in order to resist the axial movements of the root 3 of the blade 2 during a rotation of the rotor. The blocking tooth 83 is arranged so as to be axially aligned with the groove 11 of the rotor disk 1. Preferably, the rear face of the blocking tooth 83, also called the stop face, has a surface of which size is less than the cross section of the groove 11 of the rotor disk 1, as illustrated in FIG. 3. Such a blocking tooth 83 is able to carry out the blocking function, but at the same time is of reduced mass owing to the reduced dimensions thereof. According to a specific embodiment which is not illustrated, the blocking tooth 83 can be folded/retracted in order to allow simple fitting of the securing device 8 in the recess 6, the tooth 83 being unfolded/deployed only after assembly.

The securing device 8 further comprises ventilation means which are formed in the ring sector 81, preferably in the outer portion 85 thereof, between the zone of connection of the securing wedge 82 and the inner portion 84 of the annular sector 81 as illustrated in FIG. 4. These ventilation means are in the form of openings which extend through the ring sector 81 in the axial direction in order to allow a flow of air F which circulates between the base of the groove 11 and the blocking wedge 82 to be discharged, as illustrated in FIG. 4.

Preferably, the ventilation means are radially aligned with the blocking tooth 83 which allows the root 3 of the blade 2 to be axially secured whilst allowing the groove 11 to be ventilated.

According to a first embodiment, the ventilation means are in the form of circular through-holes 91, whose diameter is calibrated for the ventilation, as illustrated in FIGS. 2 to 4. Circular holes 91 have the advantage of being simple to machine.

Figure 5:
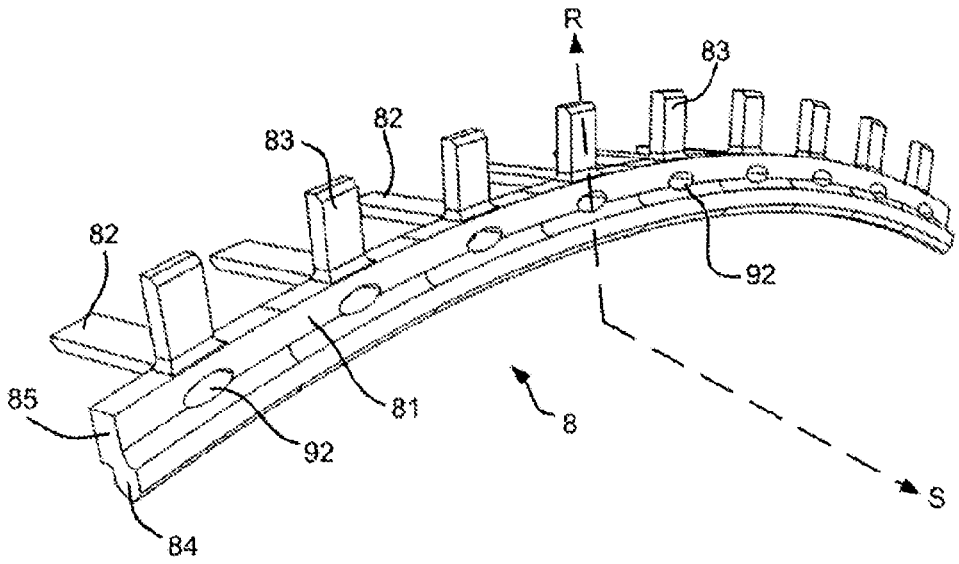
FIG. 5 is a perspective view of a second embodiment of a securing device according to the invention.

According to a second embodiment, with reference to FIG. 5, the ventilation means are in the form of through-holes 92 having an elliptical cross section whose minor diameter preferably extends in the radial direction. Holes 92 which have an elliptical cross section and which are produced, for example, by means of angled drilling, have the advantage of providing a great flow of air without affecting the mechanical strength in the radial direction of the ring sector 81. This is because the distance between the inner edge of the ring sector 81 and an elliptical hole is greater than the distance between the inner edge of the ring sector 81 and a circular hole, thus offering greater mechanical strength.

Figure 6:
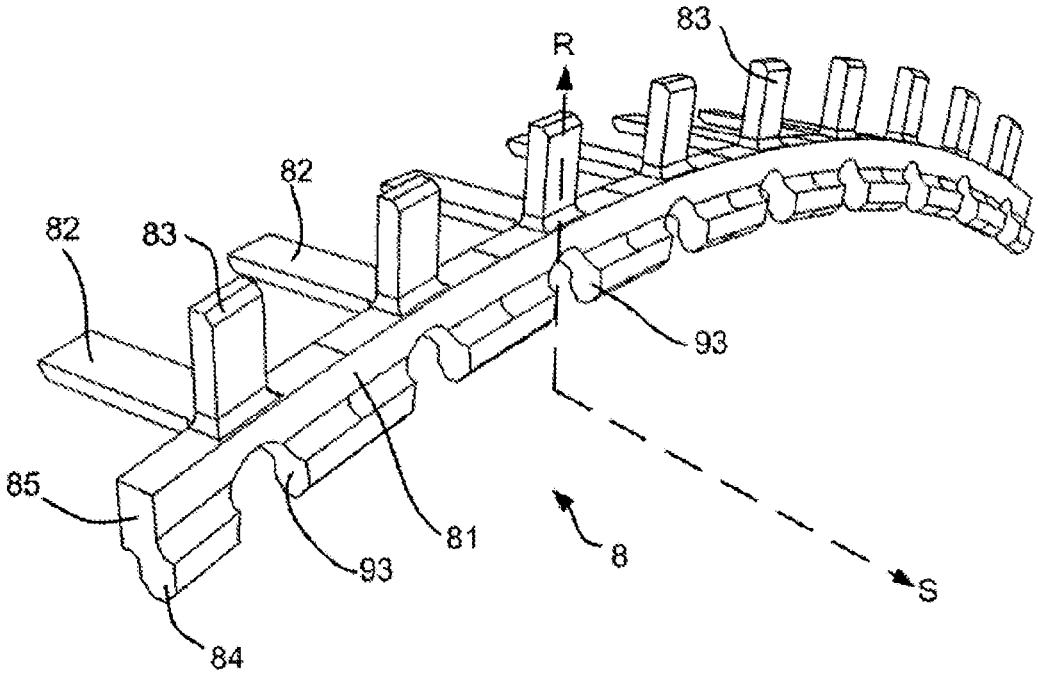
FIG. 6 is a perspective view of a third embodiment of a securing device according to the invention.

According to a third embodiment, with reference to FIG. 6, the ventilation means are in the form of notches 93 which are formed from the inner portion 84 of the ring sector 81 as far as the outer portion 85 thereof. In other words, the inner end of the ring sector 81 is notched in order to allow the ventilation of the grooves 11. Notches 93 have the advantage of reducing the mass of the ring sector 81 whilst being simple to machine by means of drilling. Furthermore, the notches 93 provide a great flow of ventilation air.

The fitting of a securing device 8 in the rotor will be described in greater detail. This fitting is described with reference to a device which comprises ventilation means in accordance with the first embodiment (circular holes). The description of the fitting method applies similarly to the other embodiments of the ventilation means.

With reference to FIG. 3 illustrating the rotor disk 1 of axis X, the securing device 8 of FIG. 2 is fitted in the rotor disk 1 by placing the blocking wedges 82 axially in the grooves 11 of the rotor disk 1 and inserting the inner portion 84 of the securing device 8 in the downstream recess 6 of the rotor disk 1 so that the upper portion 85 of the ring sector 81 is in radial abutment in the base of the groove 11 in order to form a space for circulation of a flow of air F between the blocking wedge 82 and the base of the groove 11. The axial offset further allows tilting of the securing device 8 to be prevented by limiting the overhang of the securing device 8. Indeed, if the blade 2 is in abutment with the wedge 82, the inner portion 84 of the securing device 8 moves into contact with the downstream portion of the recess 6 and this blocks the upstream tilting of the wedge 82. The blocking wedge 82 is parallel to the base of the groove 11 once fitted. The blocking tooth 83 extends radially relative to the axis of the engine and is axially aligned with the groove 11.

With reference to FIG. 4, the ventilation means, in this instance circular holes 91, extend at mid-height in respect of the space for circulation of the flow of air F between the blocking wedge 82 and the base of the groove 11, which ensures good circulation of air.

The root 3 of the blade 2 is then inserted into the groove 11 by means of axial movement in a downstream direction so that the root 2 is in abutment with the outer surface of the blocking wedge 82 in order to be retained radially and thus to prevent an error in the positioning of the blade 2 in the disk 1 and, in particular, when the engine is in the stopped state. Furthermore, the root 3 of the blade 2 is in abutment with the upstream surface (stop surface) of the blocking tooth 83 in order to be axially secured.

Owing to the securing device 8 according to the invention, it is not necessary to use a blade in the form of a fir-tree-like root or to form a hook in the blade root in order to axially secure the blade 2.

Preferably, the root 3 of the rotor blade 2 has a simple dovetail form whose casing is of composite material. It is the securing device 8 and not the root 3 of the blade 2 that carries out the functions of axial blocking, radial blocking and ventilation of the groove 11 of the rotor disk 1. Such a root 3 is simple to produce and has a reduced mass.

Preferably, the casing of the root 3 of the blade 2 is of a ceramic matrix composite (CMC) material.

The invention claimed is:

1. A device for locking a root of a rotor blade in a groove of a rotor disk of a turboengine, comprising:

a circular ring sector configured to be mounted, transversely relative to an axis of the turboengine, in a recess of the rotor disk;

at least one blocking wedge, which is fixedly joined and orthogonal relative to the ring sector and which extends parallel to an axis of the ring sector to radially support the root of the blade in the groove; and at least one blocking tooth which extends from the ring sector radially relative to the axis of the ring sector to block axial movement of the root of the blade in the groove;

wherein the ring sector comprises an inner radial portion configured to be mounted in the recess of the rotor disk, and an outer radial portion, from which the blocking tooth extends, said outer radial portion being in radial abutment in a base of the groove, and wherein the device comprises ventilation means formed in the ring sector and configured to allow discharge of a flow of air which circulates between the base of the groove and the blocking wedge.

2. The device as claimed in claim 1, wherein the ventilation means is aligned with a direction in which the blocking tooth extends.

3. The device as claimed in claim 1, wherein the ventilation means is in a form of at least one ventilation hole.

4. The device as claimed in claim 1, wherein the ventilation means is in a form of at least one ventilation notch formed in a portion of the ring sector configured to be inserted the recess of the rotor disk.

5. The device as claimed in claim 1, wherein the inner and outer radial portions are axially offset relative to each other along the ring axis.

6. A rotor of a turboengine, comprising:

a rotor disk;

at least one rotor blade; and at least one locking device as claimed in claim 1;

the rotor disk comprising a groove in which a root of the blade is accommodated and a recess in which the locking device is mounted, the blocking wedge of the locking device extend g between the root of the blade and a base of the groove.

7. The rotor as claimed in claim 6, wherein the rotor disk extends axially in a downstream direction, and the recess is formed at a downstream end of the rotor disk to block an axial downstream movement of the blade in the groove.

8. The rotor as claimed in claim 6, wherein the root of the rotor blade comprises a casing of composite material.

9. The rotor as claimed in claim 6, wherein the root of the rotor blade is of dovetail form.

10. The device as claimed in claim 1, wherein the blocking wedge is radially located between a free outer radial end of the blocking tooth and a free inner radial end of the inner radial portion.

11. The device as claimed in claim 1, wherein the circular ring sector is configured to be mounted on a downstream side of the blade.

12. The device as claimed in claim 1, wherein a downstream face of the inner radial portion is disposed downstream of a downstream face of the outer radial portion.

* * * * *